United States Patent [19]

Diehl et al.

[11] Patent Number: 5,023,968

[45] Date of Patent: Jun. 18, 1991

[54] REMOVABLE LITTER CHAIR INSERT

[76] Inventors: Phillip C. Diehl; James R. Coble, both of P.O. Box 694, Altoona, Pa. 16603

[21] Appl. No.: 377,962

[22] Filed: Jul. 11, 1989

[51] Int. Cl.[5] ..... A61G 1/00; A61G 1/04

[52] U.S. Cl. ..... 5/82 R; 5/86; 5/66; 5/187; 403/102

[58] Field of Search ..... 5/66, 81 R, 82 R, 86, 5/111, 114, 117, 187, 411, 83, 68; 403/98, 102; 297/19

[56] References Cited

U.S. PATENT DOCUMENTS

| | | | |
|---|---|---|---|
| 388,605 | 8/1888 | Walsh | 403/98 |
| 808,785 | 11/1906 | Thompson | 5/86 X |
| 2,242,311 | 5/1941 | Lucey | 5/82 |
| 2,645,540 | 7/1953 | Trimble et al. | 5/82 X |
| 2,692,153 | 10/1954 | Schleter | 5/82 X |
| 2,761,153 | 9/1956 | Mew | 5/82 X |
| 2,858,879 | 11/1958 | Branson | 297/19 |
| 3,040,340 | 6/1926 | Davis | 5/82 |
| 3,210,779 | 10/1965 | Herbold | 297/19 X |
| 3,346,890 | 10/1967 | Thompson | 5/82 |
| 3,373,454 | 3/1968 | Curtis | 5/82 X |
| 4,037,871 | 7/1977 | Bourgraf et al. | 5/82 R X |
| 4,216,556 | 8/1980 | Hauessinger | 5/82 R |
| 4,393,529 | 7/1983 | Britz | 5/82 R X |
| 4,537,392 | 8/1985 | Defibaugh | 403/102 X |
| 4,726,083 | 2/1988 | Hoshall | 5/411 |

*Primary Examiner*—Michael F. Trettel

*Attorney, Agent, or Firm*—Fleit, Jacobson, Cohn, Price, Holman & Stern

[57] ABSTRACT

A removable litter chair insert adapted to be used with a standard ambulance cot and effectively enables emergency personnel to remove patients from narrow or confined spaces such as when transporting patients from a second floor to a ground floor especially when it is necessary to negotiate steps and landings in the steps, narrow doorways, hallways and the like. The device includes a framework with a canvas type liner connected to the framework and a removable pad or mattress secured to the liner with the insert being capable of orientation in a straight line condition for use as a regular stretcher and convertable to a chair configuration to facilitate extrication of emergency patients from confined areas by ambulance personnel.

4 Claims, 2 Drawing Sheets

REMOVABLE LITTER CHAIR INSERT

BACKGROUND OF THE INVENTION

1. Field of the Invention

The present invention generally relates to a device for assisting emergency personnel in handling emergency patients and more specifically is a removable litter chair insert adapted to be used with a standard ambulance cot and effectively enables emergency personnel to remove patients from narrow or confined spaces such as when transporting patients from a second floor to a ground floor especially when it is necessary to negotiate steps and landings in the steps, narrow doorways, hallways and the like. The device includes a framework with a canvas type liner connected to the framework and a removable pad or mattress secured to the liner with the insert being capable of orientation in a straight line condition for use as a regular stretcher and convertible to a chair configuration to facilitate extrication of emergency patients from confined areas by ambulance personnel.

2. Information Disclosure Statement

Various devices have been provided to assist ambulance personnel and other emergency personnel in transporting patients from an emergency site to a hospital or other treatment facility. The following U.S. Pat. Nos. relate to this type of device:

419,572
1,131,987
2,546,604
3,956,781
4,393,529

None of the above listed patents disclose a removable chair insert that is primarily adapted to use in transporting emergency patients while in a chair mode thereby enabling emergency personnel to more effectively remove patients from restricted areas.

SUMMARY OF THE INVENTION

An object of the present invention is to provide a removable litter chair insert for use with ambulance cots in which the chair insert includes a frame with a canvas or mesh type liner attached thereto with the frame being provided with hinge structures enabling the insert to be angled in a manner to form a chair to which patients can be strapped to enable emergency patients to be more effectively and safely removed from or transported through confined areas.

Another object of the invention is to provide a removable litter chair insert having a unique hinge and lock structure enabling the chair insert to be oriented in the form of a chair or oriented with all components in alignment for use as a conventional stretcher.

A further object of the invention is to provide a removable litter chair insert having a removable pad or mattress secured thereto to enhance the use of the device as an attachment to or extension of a conventional ambulance cot or use as an independent stretcher convertible to a chair configuration to more effectively transport patients in areas where a conventional stretcher cannot be used due to space constraints.

Still another object of the invention is to provide a removable litter chair insert which is adapted for use in combination with a conventional ambulance cot or the like and which is simple in construction, easy to convert from one position to another for quick and efficient use and capable of increasing the capability of emergency personnel and enabling emergency patients to be more quickly and safely transported to a treatment site.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
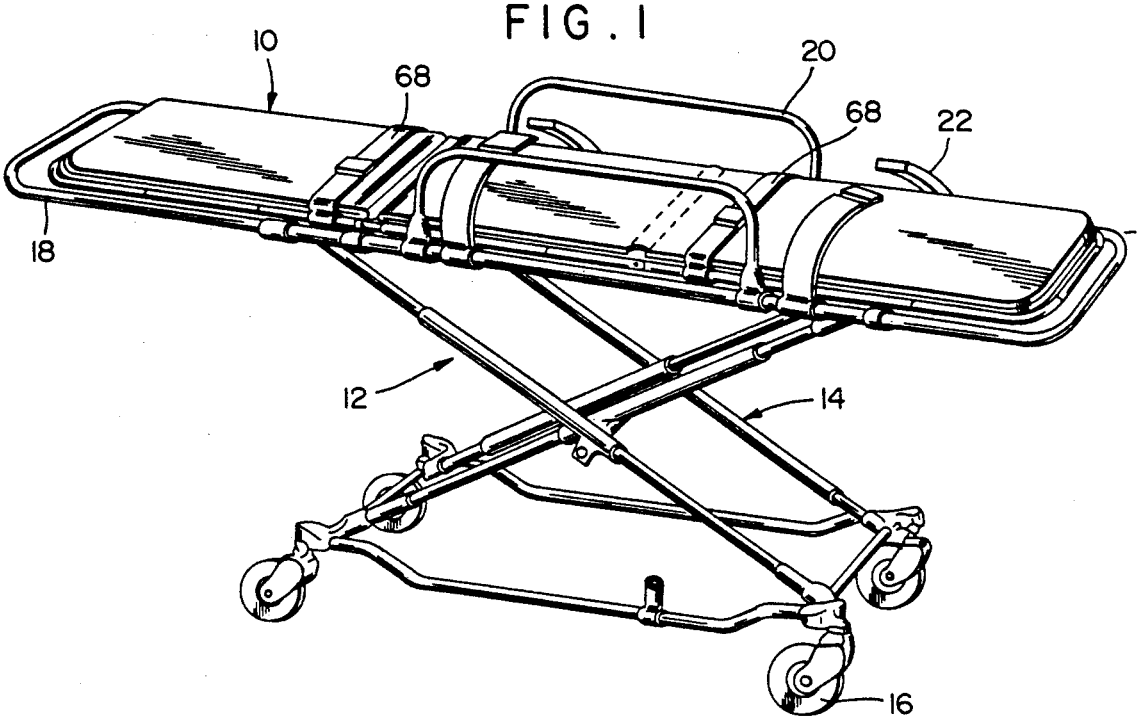
FIG. 1 is a perspective view of the removable litter chair insert of the present invention associated with a conventional ambulance cot.

Referring now specifically to the drawings, the removable litter chair insert of the present invention is generally designated by reference numeral 10 and, as illustrated in FIG. 1, the present invention is associated with a collapsible ambulance cot generally designated by reference numeral 12 and which includes a collapsible or foldable framework 14 supported by wheels 16 and provided with a frame 18 that usually includes a mattress supported thereon. The ambulance cot is a conventional item and takes various forms and configurations with the litter chair insert of the present invention being capable of resting on the ambulance cot and generally retained thereon by the upstanding guide rails or side rails 20 on the frame 18 and retaining straps 22 may be provided for retaining the insert in place and also retaining a patient in place on the ambulance cot and on the insert 10. The removable litter chair insert 10 includes a frame structure generally designated by reference numeral 24 that includes a liner 26 that may be in the form of a canvas like mesh material or the like of plastic or natural fibers such as nylon and the like. Mounted on the frame and liner is a mattress or pad generally designated by reference numeral 28. As illustrated in FIG. 1, the chair insert 10 can be oriented with all components in alignment to form a conventional stretcher or, as illustrated in FIG. 2, the insert can be oriented in the manner of a chair so that a patient can be handled while in a sitting position thereby enabling ambulance personnel to more effectively transport an emergency patient down stairwells and the like especially in stairwells having angulated stair segments and narrow halls and passageways.

The frame 24 includes a sectional arrangement including a center section 30, a foot section 32 and a head section 34 with all of the sections being defined by a peripheral tubular frame member 36 with the tubular frame member generally defining an open rectangular area when the sections 30, 32 and 34 are horizontally oriented. The side members of frame 36 are interconnected by brace members 38 (see FIG. 3) in the form of tubular members which extend transversely between the side members and are curved downwardly in a concave manner to enable the patient to be supported by the liner 26.

Figure 4:
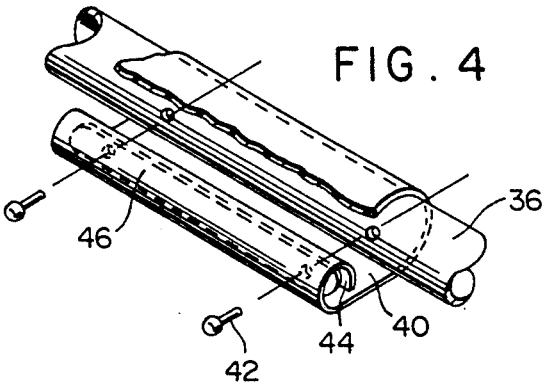
FIG. 4 is a fragmental perspective view of the attachment of the canvas liner to the frame.

The liner 26 has end portions 40 which wrap around the tubular frame 36 and secured to the tubular frame 36 by screw threaded fasteners 42 which may be self-tapping fasteners and the like with the terminal edge of the end or edge portions of the liner being reversely wrapped as at 44 with a bar-like insert 46 received therein to form an anchor for securing the end edge or side edge of the liner to the frame member 36 as illustrated in FIG. 4. This structure forms a secure attachment of reduced end portions and reduced side portions to the end and side portions of the tubular frame member 36 as illustrated in FIGS. 2–4.

Figure 2:
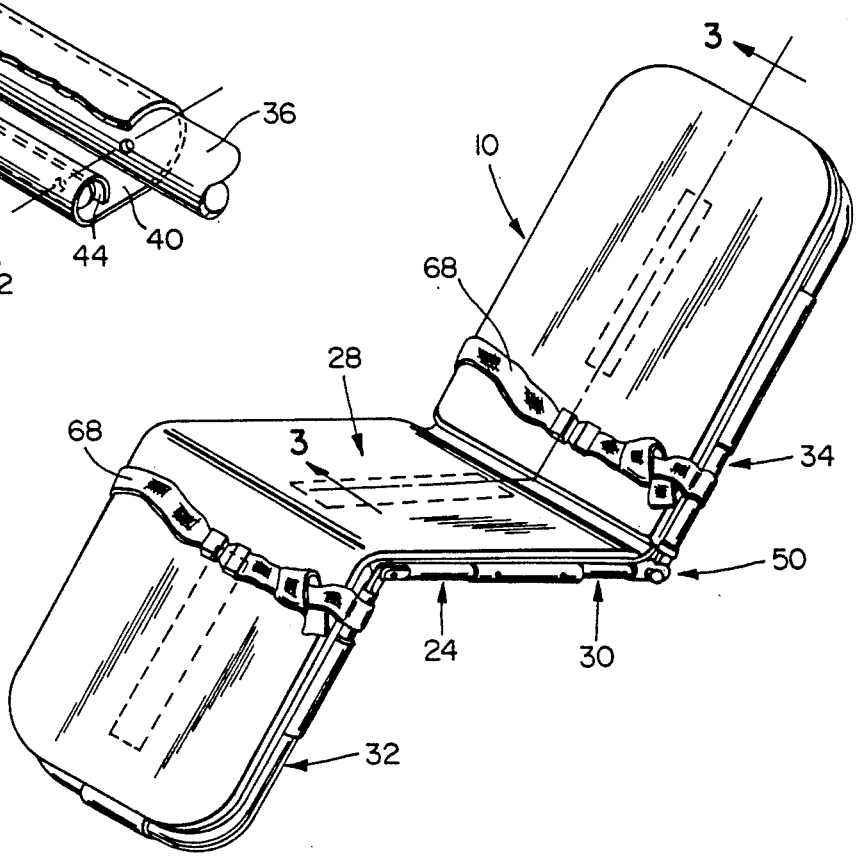
FIG. 2 is a perspective view of the present invention having its components oriented to form a chair for transporting a patient in a sitting position.
Figure 3:
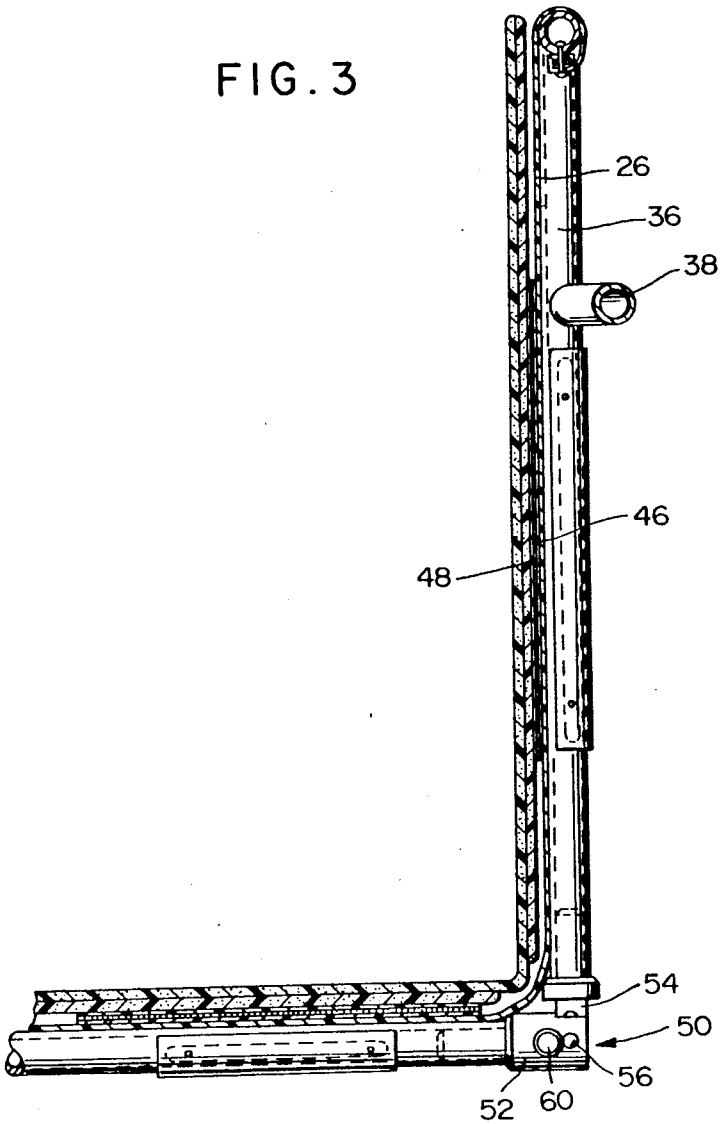
FIG. 3 is a longitudinal, sectional view taken substantially upon a plane passing along section line 3—3 on FIG. 2 illustrating specific structural details of the invention.

The liner 26 includes strips 46 of "Velcro" which match with corresponding strips of "Velcro" 48 mounted on the undersurface of the pad or mattress 28 which may be foam material provided with a skin surface or any other suitable pad or cushioning material having an overall shape and configuration corresponding to the shape and configuration of the frame 24 and being removably secured to the liner by attaching strips of "Velcro" 46 and 48 that are oriented longitudinally along the center line of the frame and mattress as illustrated in FIGS. 2 and 3. The "Velcro" material is constituted by strips of hook and loop pile material that will secure the pad or mattress in place but enable easy and quick removal thereof for cleaning or replacement as the case may require.

Figure 5:
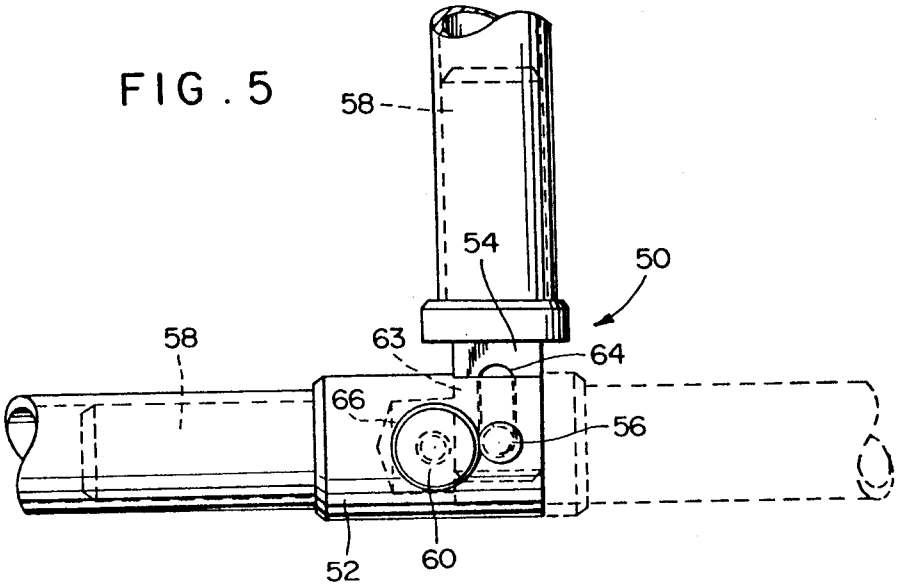
FIG. 5 is a detailed elevational view, on an enlarged scale, illustrating the hinge structure utilized in the frame of the present invention.
Figure 6:
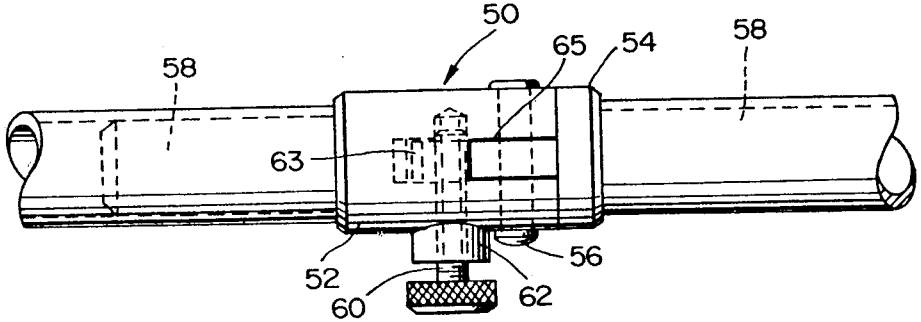
FIG. 6 is a plan view of the hinge structure of FIG. 5.

The side frame members defining the sections 30, 32 and 34 are hingedly interconnected by hinge structures generally designated by reference numeral 50 with FIGS. 5 and 6 illustrating the specific structure of the hinges 50 which includes a female hinge component 52 and a male hinge component 54 interconnected by a hinge pin 56 in the form of a rivet or the like. The hinge components 52 and 54 include a projecting stud or sleeve 58 telescoped into and rigidly affixed to the adjacent ends of the tubular frame member 36 thereby connecting the hinge to the frame rails. The hinge can be locked with the components in aligned relation or in 90° relation as illustrated in FIG. 5 with the lock structure being in the form of a thumb screw 60 which extends through an internally threaded housing 62 formed on the female hinge member and extending into locking engagement with an aperture in the male hinge component 54 thus locking the frame rail segments in longitudinal straight line alignment or in perpendicular relation or angular relation when the chair insert is to be formed as a chair. The male hinge component 54 includes a slot structure 64 slidably engaged with the pin 56 to position the male hinge component 54 with its edge portion engaging the inner edge 63 of slot 65 in female component 52 and engaged by the threaded thumb screw 60 as illustrated in FIG. 5 when the components are in perpendicular relation. Longitudinal movement is provided by the slot 64 to orient the male component so that it telescopes into a recess 66 in the female hinge component 52 thus providing a positive locking arrangement to maintain the hinge components either in alignment or in perpendicular relation to each other.

The removable litter chair of the present invention includes retaining straps 68 on the head section 34 and the foot section 32 to retain patients in position on the chair insert when it is the form of a chair and also when it is in the form of a stretcher thereby enabling the frame 24 to be easily grasped at different locations on each side by emergency personnel which will facilitate movement of patients in confined areas. The litter chair insert is primarily constructed for removing emergency patients from narrow spaces when transporting those patients from a second floor to a ground floor or the like or anytime that a patient is to be moved upstairs or downstairs and in areas having narrow hallways or other spaces. The removable litter chair insert will fit most ambulance cots and will rest on the ambulance cot to act as a mattress when not being used as a patient transport device with the insert being secured to the ambulance cot by retaining straps or other removable secured means. Thus, the removable litter chair insert can be used independently from the ambulance cot and forms an extrication aid for use by ambulance personnel or other personnel engaged in emergency transport of patients. Ambulance cots are rather cumbersome and have considerable weight which renders them difficult to maneuver up and down stairways or in tight, close spaces particularly when a patient is on the cot. By using the relatively lighter weight removable litter chair insert, a patient can be maneuvered along stairways, through hallways and the like with the litter chair insert being used either as a straight stretcher as in FIG. 1 or as a chair as in FIG. 2 with the insert being oriented with the sections 30, 32 and 34 in substantially perpendicular relation when in the chair mode.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A litter chair insert for use with an ambulance cot and convertible from a straight stretcher to a chair configuration comprising a generally rectangular frame enclosing an open area, a flexible liner in the open area attached to the frame, said frame including a center section, a foot section and a head section, lockable hinge means interconnecting the center section and foot section and lockable hinge means interconnecting the center section and head section with the lockable hinge means enabling the sections to be oriented in alignment with each other to form a stretcher or in angular relation to each other to form a chair to enable a patient to be more effectively transported down stairways, through halls having confined areas and the like, each of said hinge means includes a female component and a male component, said female hinge component including a recess receiving the male hinge components, said male hinge component having a longitudinal slot formed therein, a pin mounted in said female hinge component and extending through the slot to enable the hinge components to move axially and pivotally in relation to each other when moving between aligned and perpendicular relation, and a locking member mounted on the female hinge component in spaced relation to the pin for movement into the slot in spaced relation to the pin for locking the hinge components in aligned relation, said male component including a side edge spaced from the slot, said locking member being mounted for movement into engagement with the side edge of the male component in spaced relation to the pin in the slot for locking the hinge components in perpendicular relation.

2. The structure as defined in claim 1 wherein said liner is a canvas type liner having reduced end edge portions and reduced side edge portions, means securing the reduced end and side edge portions to the frame.

3. The structure as defined in claim 1 wherein the foot section includes a generally U-shaped tubular frame member, said head section including a generally U-shaped tubular frame member, the center section including a pair of tubular side frame members, each female hinge component including a recess opening longitudinally to the end of the female hinge component and laterally to one side of the female hinge component with the opposed lateral side of the recess being closed, said pin extending transversely of the recess, each male hinge component including a projection received in the recess and having the longitudinal slot formed therein, said pin extending through the slot and enabling the slot to move on the pin both axially and pivotally, said recess in the female component including a longitudinally extending portion extending axially inwardly from the portion of the recess having the transverse pin therein to receive the inner end of the projection on the male hinge component when it is aligned with the female hinge component and moved axially toward the female hinge component with the locking member being inserted into the inner end of the slot in the male hinge component in spaced relation to the pin when the male component is aligned with the female component thereby locking the male and female hinge components in aligned relation thereby requiring removal of the locking member from the slot during pivotal movement of the male and female hinge components between aligned and perpendicular relations.

4. A litter chair insert for use with an ambulance cot and convertible from a straight stretcher to a chair configuration comprising a generally rectangular frame enclosing an open area, a flexible liner in the open area attached to the frame, said frame including a center section, a foot section and a head section, lockable hinge means interconnecting the center section and foot section and lockable hinge means interconnecting the center section and head section with the lockable hinge means enabling the sections to be oriented in alignment with each other to form a stretcher or in angular relation to each other to form a chair to enable a patient to be more effectively transported down stairways, through halls having confined areas and the like, each of said lockable hinge means including a female component and a male component, said female hinge component including an axial recess receiving an axial projection on the male hinge component, a transverse pin interconnecting said female hinge component and said male hinge component to enable the hinge components to move pivotally in relation to each other when moving between aligned and angular positions, and a locking member movably mounted on one of said hinge components in spaced but adjacent relation to the pin for locking engagement with the other hinge component in the aligned and angular positions of the hinge components, said locking hinge being confined to an area adjacent said transverse pin thereby leaving the areas above and below the frame unobstructed, said recess on the female hinge component and said projection on the male hinge component including engageable transverse surfaces parallel to and in spaced but adjacent relation to said pin for limiting pivotal movement of the female and male hinge components to an aligned position in one direction of pivotal movement and an angular position in the other direction of pivotal movement, said hinge component lockingly engaged by the movable locking member including transverse surface areas in addition to those limiting pivotal movement engageable by said locking member when said female and male hinge components are in their aligned and angular positions.

* * * * *